US006336451B1

(12) United States Patent
Röhl-Hager et al.

(10) Patent No.: US 6,336,451 B1
(45) Date of Patent: Jan. 8, 2002

(54) PROCESS AND DEVICE FOR CONFINING, RETAINING AND SUCKING OFF FUMES, DUST OR THE LIKE

(76) Inventors: Hannelore Röhl-Hager, Schöneberger Strasse 18, D-93053 Regensburg; Georg Koppenwallner, Max-Planck-Strasse 19, D-37191 Katlenburg-Lindaa; Georg Emanuel Koppenwallner, Hahnenstrasse 13, D-30167 Hannover, all of (DE)

( * ) Notice: Subject to any disclaimer, the term of this patent is extended or adjusted under 35 U.S.C. 154(b) by 0 days.

(21) Appl. No.: 09/147,084

(22) PCT Filed: Feb. 4, 1997

(86) PCT No.: PCT/DE97/00669

§ 371 Date: Dec. 2, 1999

§ 102(e) Date: Dec. 2, 1999

(87) PCT Pub. No.: WO97/38266

PCT Pub. Date: Oct. 16, 1997

(30) Foreign Application Priority Data

Apr. 4, 1996 (DE) ..... 196 13 513

(51) Int. Cl.[7] ..... F24C 15/20

(52) U.S. Cl. ..... 126/299 D; 126/299 R; 55/DIG. 36

(58) Field of Search ..... 126/299 R, 299 D, 126/21 R, 300, 301; 55/DIG. 36; 454/49, 67

(56) References Cited

U.S. PATENT DOCUMENTS

| | | | | | |
|---|---|---|---|---|---|
| 3,513,766 | A | * | 5/1970 | Ahlrich | 126/299 D |
| 4,043,319 | A | * | 8/1977 | Jensen | 126/299 D |
| 4,153,044 | A | | 5/1979 | Nett | |
| 5,050,581 | A | * | 9/1991 | Rohl-Hager et al. | 126/299 R |

FOREIGN PATENT DOCUMENTS

| | | |
|---|---|---|
| DE | 23 40 533 | 3/1975 |
| DE | 2340533 | 3/1975 |
| DE | 3304262 A1 | 8/1983 |
| DE | 39 18870 | 12/1990 |
| DE | 39178870 A1 | 12/1990 |
| DE | 4203916 C1 | 4/1993 |
| DE | 42 03 916 | 4/1993 |
| JP | 63-025430 | 7/1986 |
| JP | 63025430 | 2/1988 |

* cited by examiner

*Primary Examiner*—James C. Yeung
(74) *Attorney, Agent, or Firm*—Hoffman, Wasson & Gitler

(57) ABSTRACT

Processes and devices for confining, retaining and sucking off vapors, fumes, dust or similar materials including dispersed or dissolved vapor particles in a fluid medium. In order to separate these pollution particles, a fluid boundary layer or front is generated by diverting a jet against a boundary surface. The curved jet forms a vortex flow retaining the particles and transports them to the suction surfaces. The process and device are especially useful for exhaust hoods in the kitchen field and in the field of clean rooms, furthermore, in those fields, where fluid media with different characteristics are to be separated, confined and suctioned off.

30 Claims, 9 Drawing Sheets

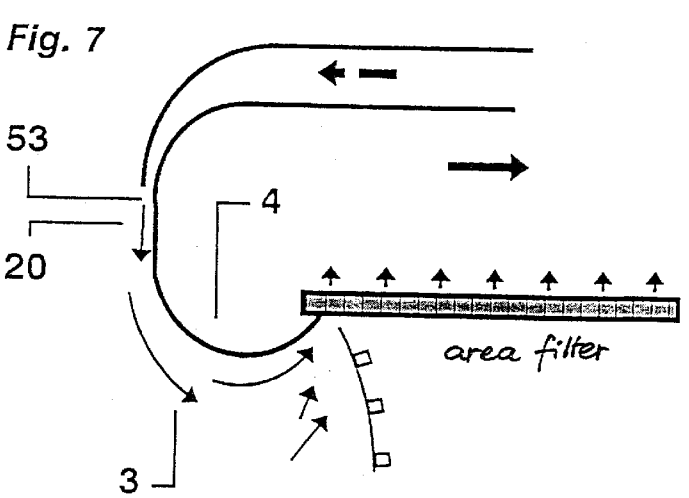
Fig. 7
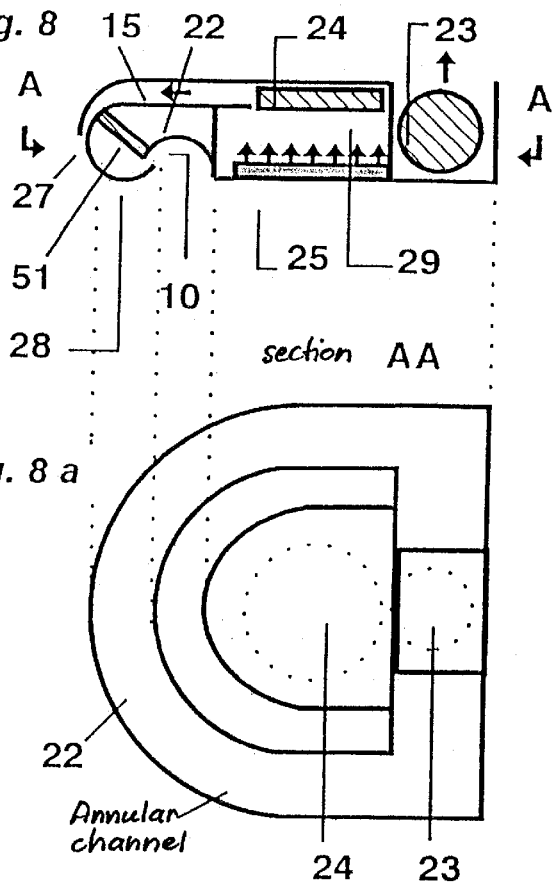
Fig. 8
Fig. 8 a
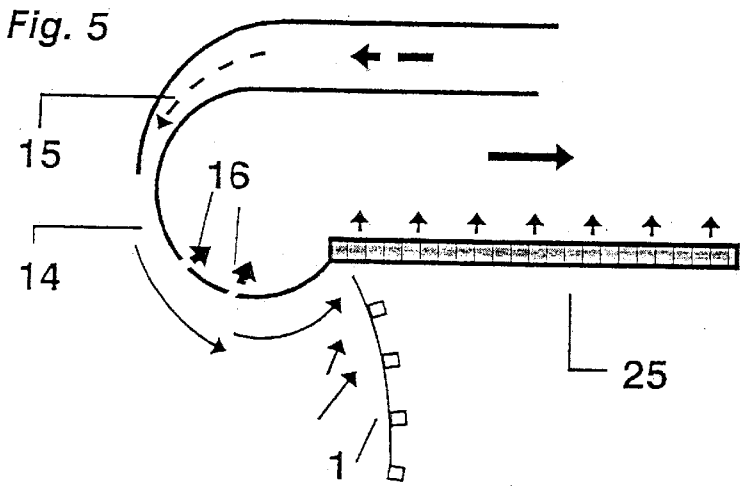
Fig. 5
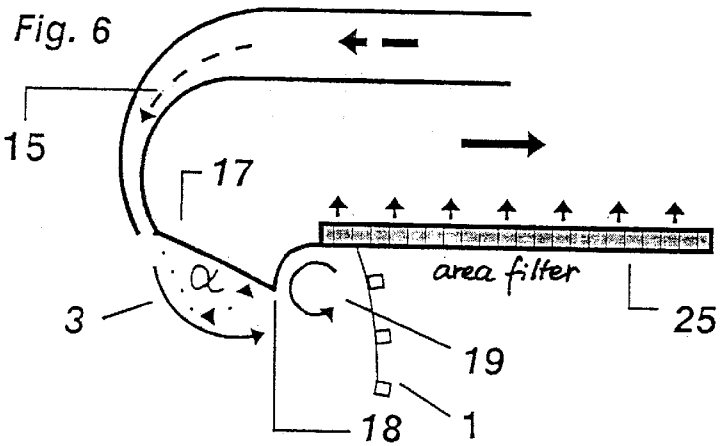
Fig. 6

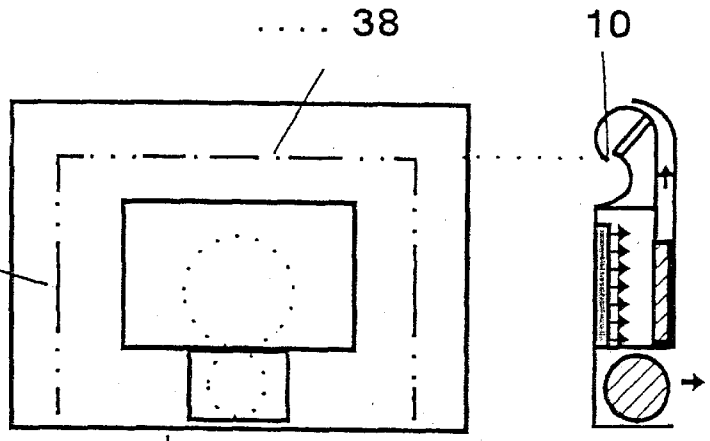
Fig. 11
Fig. 11 a
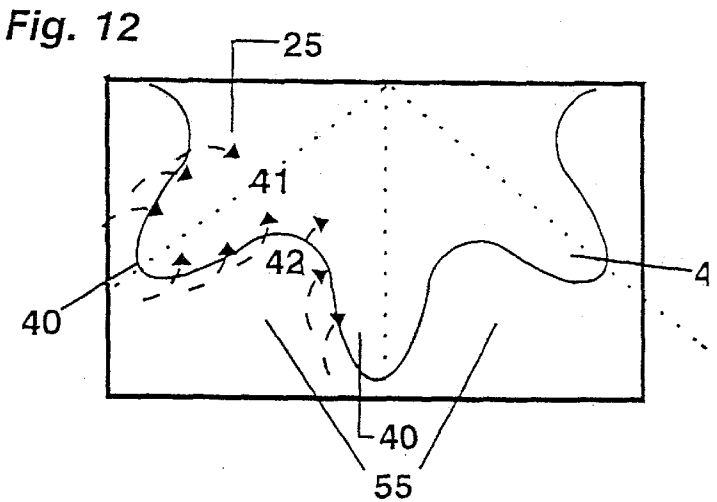
Fig. 12
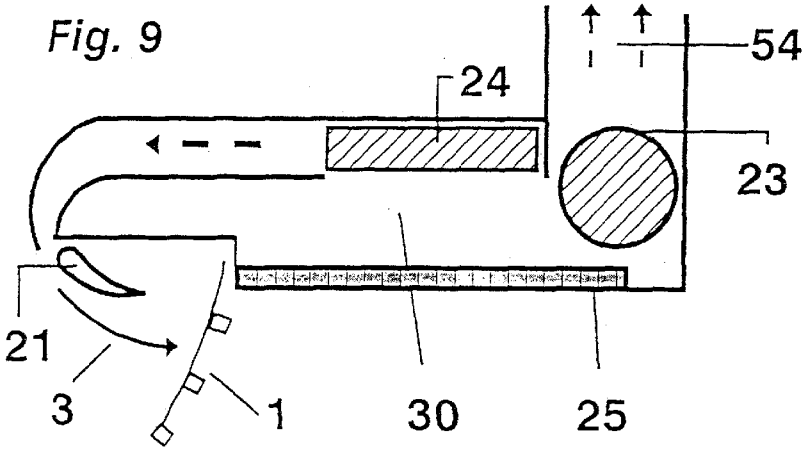
Fig. 9
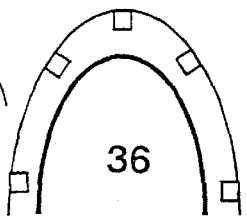
Fig. 10 c
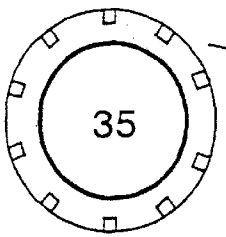
Fig. 10 b
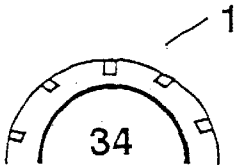
Fig. 10 a

PROCESS AND DEVICE FOR CONFINING, RETAINING AND SUCKING OFF FUMES, DUST OR THE LIKE

This invention refers to a process and a device for confining, retaining and drawing off vapors, fumes, dust or similar fluid materials, resulting from kitchen ovens, cooking places and industrial working stations. However, the invention also can be used for retaining and drawing off other fluid materials, such as solutions, dispersions or suspensions. Especially, the invention refers to exhaust hoods to be used in the kitchen field and in the field of clean-air rooms.

Vapors, dust, fumes and the like are pollutants to be removed from air by drawing off the pollutants through a filter, for example a vapor hood. These materials often are included in very fast and turbulent streams of air. A mere suction flow is not suitable for retaining such streams because it's intensity nor it's stability is sufficient to divert and draw off a turbulent flow. For this reason the volume of the drawing off stream is chosen to be considerably larger than the volume stream of the pollutants, or a larger suction screen with high suction power is used.

DE 39 18 870 C2 discloses a method for improving the suction flow field of an exhaust hood. A downwardly directed free jet and a wall jet directed towards the suction surface cooperate with each other and generate a frontal vortex. The flow field produces an aerodynamic wall around the exhaust hood.

DE 42 03 916 C1 discloses a process for forming a blast flow according to DE 39 18 870 in such a manner that it results in a higher inherent stability and is formed as a helix, and passes the frontal vortex along the lateral sides of the exhaust hood. The drawback of both described processes is the expensive structure of a twin slot nozzle for generating the frontal vortex and the wall jet, as well as the problem in diverting the frontal vortex at the edges of exhaust hoods.

DE 33 04 262 C2 discloses a recirculation hood forming an air curtain around the lateral walls of an exhaust hood. As can be seen from the Schlieren photographs of this type of air curtain, no distinguished front is generated. Especially, this type of recirculation hood is to be further developed and improved by the subject invention.

In the field of meteorology, the expression 'front' is the boundary between different air masses. A front is a strongly convergent flow area on which extreme gradients, for example temperature or moisture gradients, preferably adjacent to boundary surfaces, such as the ground or a wall can occur. According to the invention, this type of front also is generated as an area of flow between the vapor section and the blow out area of the exhaust hood.

It is an object of this invention to improve the suction flow field of an exhaust hood for vapors, fumes and dust in such a manner that vapors, fumes, and/or dust are separated from ambient air, and a front is formed.

SUMMARY OF THE INVENTION

A blast jet exiting around the front edge of the hood is diverted into a movement extending towards the suction surface, and is transformed into a vortex or a curved shearing flow or shearing layer. Ideally, a vortex comprises a fixedly rotating nucleus surrounded by a shearing flow or a shearing layer. For generating a front it is vital that the shearing flow is able to build a convergent stream field generating a front if the stream hits a wall or a counter-stream. With the invention front vortexes, as well as vortex or shearing streams are generated, and devices are proposed which build a front on the underside of the exhaust hood in a more stable and more effective manner, and also generate helical suction flows.

Diverting a jet for obtaining a curved vortex or shearing flow is obtained in different ways:

1. A direct suction effect acts upon a jet. The jet is blown out at the front edge of the hood into the area below the hood and, by means of gap suction formed within the deeper inner edge area of the hood, is diverted towards the bottom surface of the hood. Optimum orientation of the jet depends upon the intensity and the distance of the edge suctioning from the blast slot. Preferably, the jet is orientated in an angle of +/−30° to the vertical in order to obtain a positive generation of a front vortex and a front layer. The aperture of the suction slot is provided towards the center of the hood. The exit aperture and suction aperture in their most simple embodiments are separated from each other by a straight surface, the distance depending on the radius of curvature. The suction rate is in the order of the exhaust rate and is approximately 3–5 m/sec. In front of the suction slot, a trough can be arranged to act as a receiving trough and as a means for diverting the suctioned free jet and the vapor elements pulled along with the free jet.

2. The jet diversion is caused by the action of the Coanda effect on a wall jet over a curved surface or by blowing the jet in an inclined direction over a plane surface. The suction effect causing a curvature and acting upon a free jet also can be generated by a free jet by blowing the jet over a curved surface. Such jet adheres to the curved surface and is diverted up to 240°. This effect is known as the so-called Coanda effect and generates a vortex flow or a shearing flow. The curved surface takes the function of a vortex nucleus, either partly or totally. If a break edge is provided within the curvature, a vortex can be generated at this break edge. A jet is directed outwardly over a circular profile or a partial circular profile in a horizontal direction and generates a flow which at the bottom side of the hood is directed against the interior of the hood. For improving the adherence of a wall jet on a curved surface boundary layer, suctioning can be provided within the area where the flow separates from the surface.

A further possibility to provide a jet with a curved direction is to blow the jet at an angle a in view of the exit direction towards an inclined plate, a correspondingly inclined profile or a curvature if the jet adheres to the plate at an angle of $0<\alpha<50°$. This is possible with a plate which is approached with the indicated range of angles. The jet adheres in a distance of 5–30% of the thickness of the blow out slot behind the slot at an angle of $25°<\alpha<30°$.

Another way of diverting the jet is to blow it onto a straight surface in a tangential direction, which means that $\alpha=0°$, and the jet is a wall jet. This plane surface is joined by a curvature or a profile in order to generate a corresponding flow. If a half-circular, a circular segment type, a profiled or a similarly curved element is inserted between the vertical blast jet and the horizontal wall jet of a nozzle according to DE 39 18 870 C2, the effect of the process according to the invention will improve because the nucleus of the generated front vortex does not need to be built up completely or partly. Therefore, a larger proportion of the jet can be transformed into a vortex flow for generating a front.

3. Another possibility of diverting the jet is to direct a free jet leaving the front edge of the hood against a profile in such a manner that the jet is diverted in the direction towards the bottom side of the hood and towards the interior of the hood so that a curved vortex or shearing flow is generated. Such diversion of the jet towards the bottom side of the hood is equivalent to the effect of a flat of an airplane which, at high angles of incidence, passes the approach flow towards the airfoil profile.

4. A fourth possibility of diverting the jet is to combine the generation of a front vortex or a front vortex type flow according to the above possibilities mentioned in items 2 and 3 with edge suctioning according to item 1, whereby surface suctioning can be dispensed with.

If several fans are used within an exhaust hood, either all fans can be operated in the suction mode, and part of the suction air can be diverted, or alternatively, separated fans for suctioning off or fans for blowing out vapors are used. The former process lends itself to an option if a single fan is used. When operating in the air outlet mode there is the disadvantage that the amount of air for the jet depends on the resistance of the air outlet conduit. In this case, the relation between jet volume flow and air outlet flow dependent on the used air outlet conduit is to be adjusted by throttles within the air outlet channel and the blast air channel so that this method preferably is used for hoods operating in the recirculation mode. The suctioned airflow is divided into the blast jet and the recirculated jet. The recirculated air, similar to commercial hoods operating in the recirculation mode, can be blown into the area above the hood.

According to the second version described above, throttles can be dispensed with because a differentiation is made between the suction fan and the fan for generating the jet and the front which is called the vortex fan. A vortex fan blows out via the blow-off slot. The corresponding volume flow is dependent on the apparatus. A vortex fan is able to remove air by suction, as well as through its surface filter as by means of edge suctioning or from the surroundings above the hood, and a suction fan can be operated with both suction modes.

The suction flow field can be improved by means of corresponding structural designs. One possibility is to homogenize the steam. If the basic shape of the hood is a circular segment, an ellipsoid segment or a similarly curved shape, the front are at the wall connections of the exhaust hood only. A continuous ring-like shape without any lateral restrictions and irregularities of the front vortex is especially suitable for suspended exhaust hoods. This is true for all suctioning processes, which operate based on vortex flow or a front vortex for generating a front along the forward edge of the hood.

For cornered or rectangular exhaust hoods operating with edge suctioning, it is useful to partially interrupt the suction flow in order to obtain U-shaped vortex-type interruptions and to increase the length of the front. The width of said interruptions is approximately two-fold up to twenty-fold the thickness of the suction slot, whereas the length of the suction apertures is approximately two-fold up to thirty-fold the thickness of the suction slot. The length of the interruptions and apertures along the suction edge can be the same size or can be of different size.

With exhaust hoods or similar suction hoods without edge suctioning, the stream directed towards the filter surface is structured by tongue-like or wave-like formations of the suction surface. On locations where a tongue is positioned closer to the edge of the hood, an area of convergence is formed, whereas on those locations where a gap is provided between two adjacent tongues, an area of divergence is formed at the bottom side of the hood. A pair of longitudinal vortexes is associated to each tongue. The pair from adjacent gaps at the bottom side of the hood rotate towards the tongue and the exhaust effect.

If a blast flow is used for an exhaust hood generating a front, said flow can be formed by additionally corrugating the edge of the hood and the blow out slot. This is done in such a manner that the flow being diverted at the front side of the hood is provided with a component to the center line of the recess. The recesses or wave crests are areas of convergence, the wave troughs are areas of divergence below the hood. The results in longitudinal vortexes within the flow.

According to a special embodiment of an exhaust hood of the invention using the Coanda effect and a rectangular basic surface of the hood, it is useful to stagger the blow out aperture away from the front edge of the hood towards the interior (towards the center of the hood) in order to restrict the suction effect of the jet below the extension to the front half of the chamber underneath the exhaust hood. Compared with a blow out opening immediately at the front edge of the hood the suction effect of the jet is amplified in this manner. The distance is case of a special embodiment is approximately 50 mm. In general, it is sufficient to blow out at the front side of the hood only, whereby with a special embodiment the blow out slot is 4–5 mm, the blow out rate is 2–3 m/sec and the tube diameter is 38 mm. At the lateral restrictions of the tube circulated by air, longitudinal vortexes are formed which suppress the removal of the vapor at the lateral edges of the exhaust hood. In order to obtain a satisfying effect of these longitudinal vortexes, the vortexes also are to be arranged beyond a shield. The end of the blow out slot and the buve, therefore, is to be spaced from the lateral edges by about 50 mm. When operating in the recirculation mode, it is useful to let that part of the recirculating air which is not blown over the curvature, flow as slow as possible and over a large area. This exit location is spaced as far as possible from the front side of the hood because this flow is able to exert a suction effect onto the vapor so that the efficiency of the hood is considerably reduced.

According to a further special embodiment of the invention, the exhaust hood is formed so that two or more blasts jets are each provided with means for generating a curved shearing flow, which operate parallel to each other. A blast jet within the exhaust hood is divided into two separate jets, which overlap each other along their lateral area of curvature at the edge of the hood in such a manner that the outer curved wall is shorter than the inner curved wall. Two shearing flows spaced from each other will be obtained.

A special embodiment of the invention refers to a Coanda vortex hood. The blow out aperture is shifted or is spaced from the front edge of the hood towards the rear side. This restricts the suction effect of the jet below the extension to the semi-space, and amplifies the suction effect of the jet compared with a blow out aperture exactly at the front edge of the hood. In this case, it will be sufficient to blow out at the front side of the hood only. At the lateral restrictions of the tube circulated by air, longitudinal vortexes are formed, preventing the vapor from disappearing at the lateral edges of the hood. With comparable known systems, the longitudinal vortexes have been generated by special diversion means. For an acceptable structure of longitudinal vortexes, it is important that they are formed below a shield. The end of the blow out slot and the tube, therefore, is to be spaced distant from the lateral edges. In the recirculation mode, it is useful to make that part of the circulating air not blown out over the curvature exit as slow as possible and over a large area. The exit location is to be spaced as far as possible from the front edge of the hood because the flow can exert a suction effect onto the vapor or fumes which would reduce the efficiency of the hood.

A further embodiment of the invention refers to a combination of frontal vortexes with edge suctioning, whereby the effect of suctioning off will be improved. With frontal vortex hoods operating with edge suctioning effect, the experts differ between blast edges and suction edges of an exhaust hood. The blast edge is an edge for blowing off in order to generate a frontal flow directed toward the suction off apertures. A suction edge is an edge at which the air is removed by suction. The edges of an exhaust hood can be blast edges, blast and suction edges, suction edges or merely lateral edges (without any function as blast or suction edges).

The edge suction effect operates either with strip-like surface filters at the edge or with a slot at the edge, whereby the filter is arranged behind the slot.

Often, exhaust hoods do not justify the expenditure to arrange means for generating a frontal vortex along the entire hood edges or along the entire periphery of the hood. In these cases, a hood edge or part of the periphery of the hood will be provided with blow out apertures. The edge suction effect preferably is designed so that along a gap a very high suction speed substantially equivalent to the speed of the blast flow is generated. The channel is widened in order to keep the speed of air as low as possible when passing through the filter. However, a wall-type surface suction effect will be possible at the edges instead of a slot suction effect.

Improving the flow at the corners or at the end of the blow out means for generating a front vortex according to the invention is obtained by:

a) profiling the blow out means, b) boundary layer suction, c) positioning of the suction surface in a proper manner, d) using an adhering jet, and e) using a vortex tube.

The blow out flow of a front vortex hood at the lateral restrictions of the blow out slots is no longer "quasi two-dimensional". Experience shows that the flow at this location no long adheres as well on the lower edge of the hood, and sometimes is directed downwardly. In order to make the flow adhere as much as possible at the corners and to improve the stability, the surface of the curvature to be passed by air is profiled inclined less towards the end of the blow out aperture so that the tendency for the flow to separate caused by the shape is continuously decreased. This corresponds with the offset of a wing, the angle of adjustment of the profile of which decreases outwardly or the shape of the profile alters outwardly (geometrical and aerodynamical offset). In case of a freely profile body circulated by air, the offset can be made according to the profile of the wing.

With a further embodiment of the invention, a tube circulated by air is provided. The outer profile is a straight extension of a tangent to the curvature, whereas inside the blow out means the extension is increasingly shortened. The transient to the tube is designed as smooth as possible.

According to another embodiment lateral suction apertures close to the ends of the blow out means are provided for stabilizing the flow laterally. Furthermore, at the ends of the blow out means, a boundary layer suction effect can be provided.

Another alternative is to blow out a second wall jet, which in connection with a tube, acts as an adhering jet. This is adequate to a twin jet principle. The tube is provided with an inlet for the air of the adhering jet laterally within the interior of the hood. Below the hood a slot is arranged, from which the adhering jet exits. By positioning the inlet an d the outlet openings as well by diversion means the adhering jet can be directed inwardly.

Extending the frontal vortex or the curved shearing flow by means of an additionally general longitudinal vortex at the ends of the blow out means is a further alternative of the invention. Stabilizing the blast flow by off-setting, by boundary layer suction close to the suction surface or by an adhering jet, also can be used at other critical locations of the blow out device.

Furthermore, the invention proposes a suction device designed as a so-called vortex tube, where a radial and an axial flow are continuously merged so that this flow is formed into a rotating jet when exiting. This flow is suitable as an extension of a blow out flow. A vortex flow can be arranged at the outside of a tube around which the flow is passed. The tube also forms the air supply for the vortex tube. The air for the vortex tube also originates from the blast area of the hood and passes through the aperture within the tube through the inlet into the vortex tube. The jet flowing out from the exit aperture is diverted towards the suction surfaces. If the exit of the vortex tube is not centrically formed within the truncated cone, it will be below the bottom of the hood. However, the vortex tube also can be arranged sloping downwardly into the space below the bottom of the hood, and the truncated cone used for converging the flow can extend into the required direction. The rotational sense of the frontal vortex and of the longitudinal vortex is provided so that the longitudinal vortex forms an extension of the frontal vortex at the corners. A vortex tube is suitable for continuing the frontal flow structure laterally, if corner exhaust hoods are used. However, it can also be used to semi ring-shaped hoods, whereby the hollow body, such as a tube, can change into a vortex tube.

Further possibilities for making the flow at the lateral sides of the exhaust hood more stable are obtained by continuously decreasing the thickness of the blow out gap outwardly so that the relation of the thickness of the gap to the radius of curvature is decreased. From practical experiments with the Coanda effect, it si known that the angle of diversion of the flow is larger, the smaller the relation has been chosen. A further method is to increase the radius of the circular profile outwardly with constant thickness of the blow out slot. The profile or the way of blowing out air through the blow out device is to be designed so that there will be a longer contact time of the flow. This principle also is met by profiling the blow out device as mentioned above. Basically, the blow out device also is to be offset in a suitable manner, for example, by profiling or according to the geometrical offset of an airplane wing.

BRIEF DESCRIPTION OF THE DRAWINGS

In the following, the invention is explained in connection with the drawing with examples of embodiments. The drawings show:

FIG. 5 is a diagrammatic representation of the front side of a hood with curved blast jet guide and boundary layer suctioning, FIG. 6 is a diagrammatic representation of the front side of a hood with inclined blast jet guide and with stalling edge, FIG. 7 is a diagrammatic representation of the front side of a hood with blast jet guide on a vertical and joining curved surface, FIG. 8 is a diagrammatic representation of an exhaust hood with curved blast jet guide, suction trough, edge suctioning and suction ring channel, FIG. 8*a* is a top view of FIG. 8 along line A—A, FIG. 9 is a hood system with common suction space for a vortex fan and a suction fan with free jet suctioning along a profile body, FIGS. 10*a*, 10*b* and 10*c* are semi circular, circular and semi elliptical basic shapes of an exhaust hood, each with a surrounding front, FIG. 11 is an exhaust hood with edge suctioning and interruptions within the suction gap, FIG. 11*a* is a plan view of FIG. 11, FIG. 12 is a diagram of a tongue-like suction surface for forming areas of convergence and divergence.

DETAILED DESCRIPTION OF THE INVENTION

Figure 1:
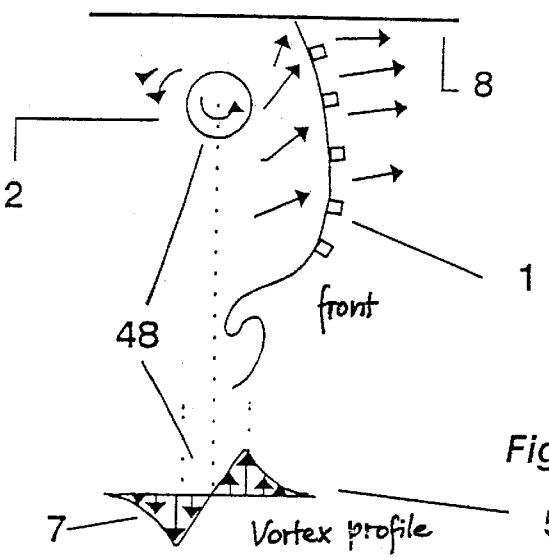
FIG. 1 is a basic diagram of generating a front by means of a front vortex.
Figure 2:
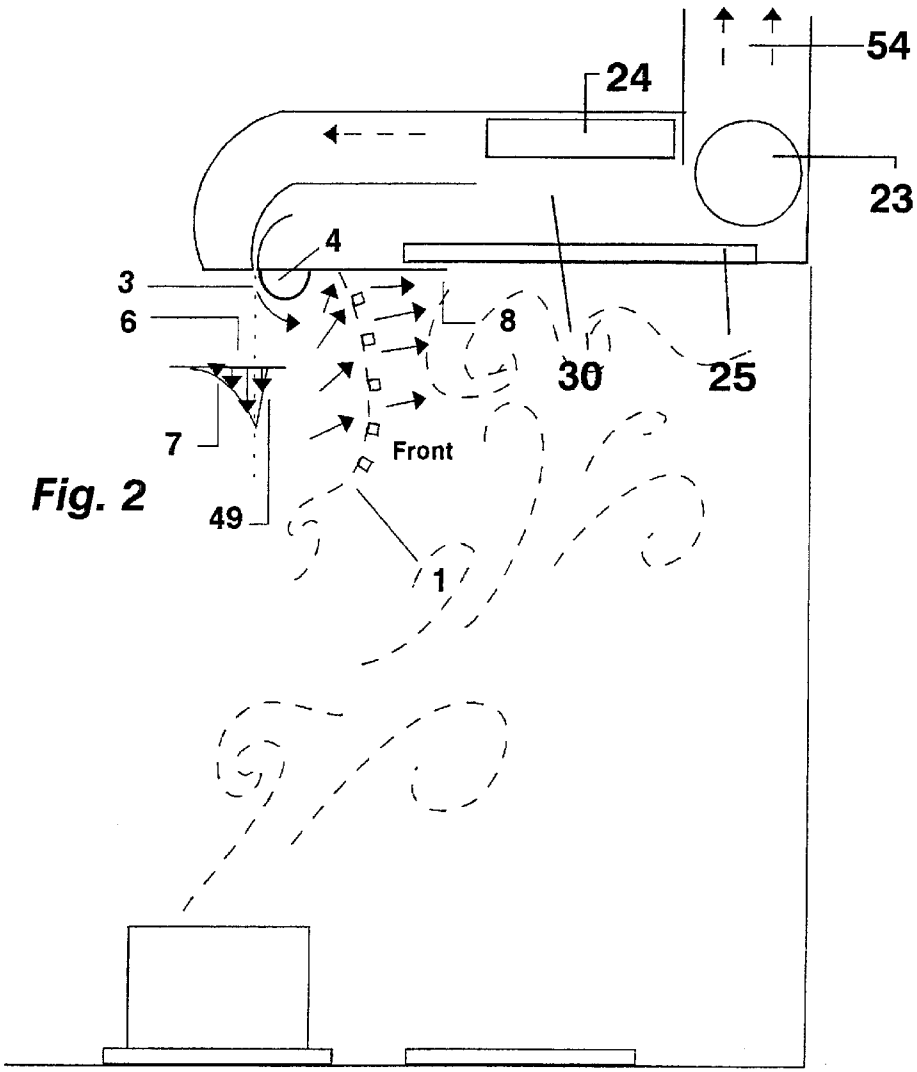
FIG. 2 is a basic diagram of generating a front by means of a vortex or shearing flow.

According to FIG. 1, a front 1 is generated by a front vortex 2 around an exhaust hood with a bottom side 8. In FIG. 2, the front 1 is generated by a curved shearing or a vortex flow 3. FIGS. 1 and 2 show within an exhaust hood system, the difference between a front vortex 2 and a curved shearing or vortex flow 3, as it is obtained if air flows over a curved surface 4. The schematic flow profiles 5 (FIG. 1) and 6 (FIG. 2) depict the nucleus 48 of the front vortex 2 rotating fixedly and a shearing layer 7 joining outwardly, and that if air flows over a curved surface 4, which in FIG. 2 is a circular profile with the same radius as the nucleus 48 of the front vortex 2, a boundary layer 49 will be obtained followed by a shearing layer 7 away from the wall, around which the air flows. The two flow areas 7 and 49 are shown separated from each other in FIG. 2 by a dotted line. When cooperating with the bottom side of the hood, a convergent flow is obtained, which generates a front 1. Front 1 is dynamic and is caused by a vortex or shearing flow.

Figure 3:
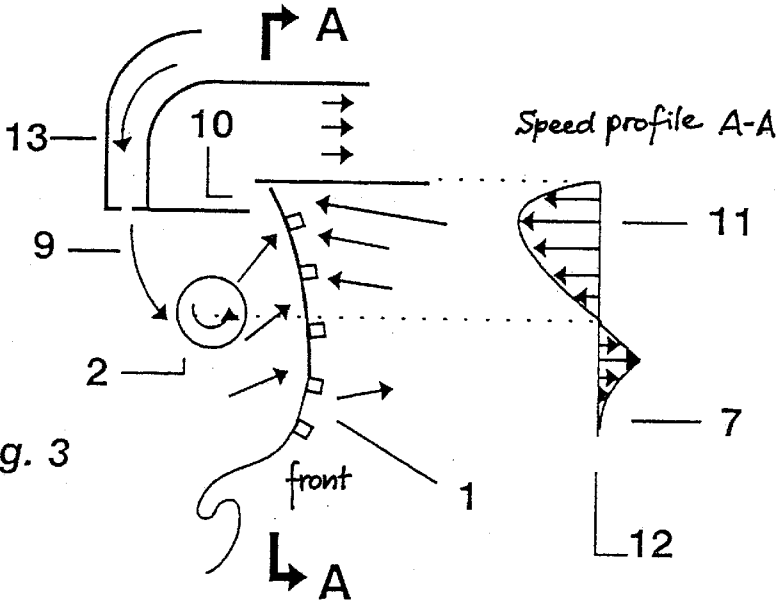
FIG. 3 is a basic diagram of the front side of a hood with blast jet and edge suctioning.
Figure 4:
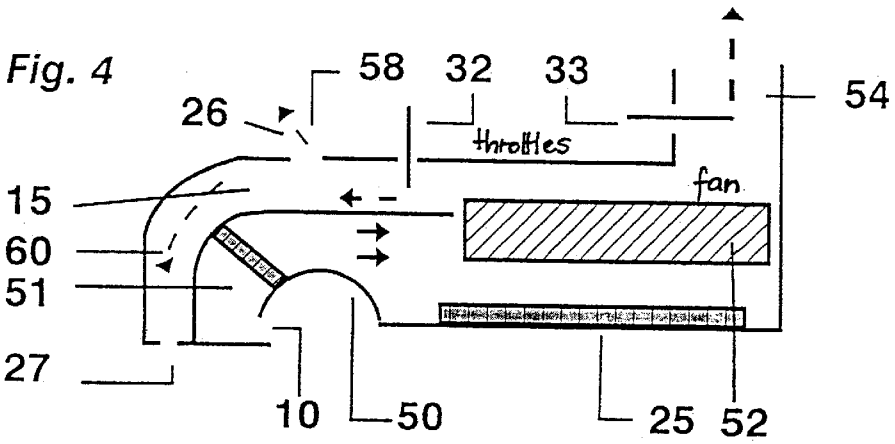
FIG. 4 is a diagrammatic representation of an exhaust hood with blast jet, edge suctioning, suction trough and surface suctioning.

With an exhaust hood according to FIG. 3, the generation of a front vortex 2 and a front 1 with boundary suction is shown by use of the suction slot 10. The front vortex 2 is generated by diverting a free jet 9 exiting at the front side 13 of the hood. Profile 12 shows that the suction flow 11 in front of the suction slot 10 joins the shearing layer 7 of the front vortex 2. FIG. 4 shows an exhaust hood with the front side 13 of the hood according to FIG. 3, but with an additional suction trough 50 and a surface filter 25 for sucking off vapor. Vapor, fumes or the like are engaged by either the suction slot 10 of the edge suction effect and is sucked off by the edge filter 51, or is held at the bottom of the hood and is sucked off by a surface filter 25. The blast airflow is indicated by dotted lines 60, and the exiting circulating air by 26. The blow out slot 27 through which the blast air 60 leaves the hood is also seen. If an exhaust hood has a fan 52 or several fans from which the blast air is branched-off. In the exhaust mode, the required blast volume flow can be adjusted by means of throttles 32, 33 within the exhaust conduit 54 and within the blast channel 15. If this type of exhaust hood is exclusively used for recirculation mode, adjustable throttles 32, 33 can be dispensed with. The air sucked through filter 25 either exists as circulating air 26 through one or more slots 58, or as blat air 60 through the exhaust slot 27. By correspondingly dimensioning the slots 58 and 27 in a suitable manner, the relation between circulating air 60 and blast air 26 is determined.

According to the embodiment of FIG. 5, the blast air 15 flows from the blast channel along a curved surface 14 as an edge suctioning effect, and forms front 1. The curved surface 14 has apertures 16 which by boundary layer suctioning improve the adherence of the jet so that under the effect of destabilizing vapor streams, larger diversions will be possible.

With the embodiment according to FIG. 6, blast air is blown-out from the blast channel 15 over a plate 17 inclined in view of the blow out direction at an angle $\alpha$. The curved shearing or vortex flow generated thereby is indicated by numeral 3. There is a break edge 18 generating a break vortex 19 acting upon front 1.

A variation of the embodiment according to FIGS. 5 and 6 is shown in FIG. 7. In this embodiment, the blast air exits via a plane surface 53 as a wall jet 20 at an angle $\alpha=0°$ from the blast channel and flows along a curved surface 4 joining the channel, resulting in a curved shearing or vortex flow 3 directed against front 1.

A further variation of an exhaust hood according to the invention is depicted in FIG. 8 having a surface suctioning effect and an edge suctioning effect combined with a blow out effect along a curvature, of or blowing at, a profile. A suction fan 23 suctions air from the vapor area through a ring channel 22 with suction slot 10 over an edge filter 51. Another fan 24 suctions air through a surface filter 25 in the center of the hood from the vapor area and blows the air through the blast channel 15 to the blow out slot 27. This embodiment of an exhaust hood is especially suitable for sucking off oily vapors since the oil can be deposited within a collecting channel 28. Fans 23 and 24 are provided with a separate suck-off chamber 29, the space between vortex casing 24 and filter 25, and the ring channel 22. As shown by section A—A in FIG. 8*a*, this exhaust hood has a substantially semi-circular shape.

With an exhaust hood according to FIG. 9, a curved vortex flow 3 is generated by sucking the blast air over a profile 21, such as a wing profile, and is directed against a front, which restricts the vapor area at the other side and draws in the air along a surface filter 25. Vortex fan 24 and suction fan 23 are supplied from a common suction space 30. If separate vortex fans are provided, as according to the embodiment of FIG. 9, the blast volume flow is independent from the flow resistance of the exhaust conduit joining the connection 54.

With the basic designs of exhaust hoods according to FIGS. 10*a*, 10*b* and 10*c*, the hood is a semi-circular hood 34, a circular hood 35 and a semi-ellipsoid hood 36. Each are able to generate a front, the schematic shape being designated by 1. An exhaust hood similar to the one shown in FIG. 8 is shown in FIGS. 11 and 11*a*. FIGS. 11 shows a rectangular hood, having interruptions 38 of the suction slot 10 of the edge suction.

FIG. 12 shows a surface filter 25 provided with tongues or wave crests 40, resulting in a convergence 41 of the suction flow, as well as indentations or wave troughs 55, located between said wave crests, and result in a divergence 42 of the suction flow.

Figure 13:
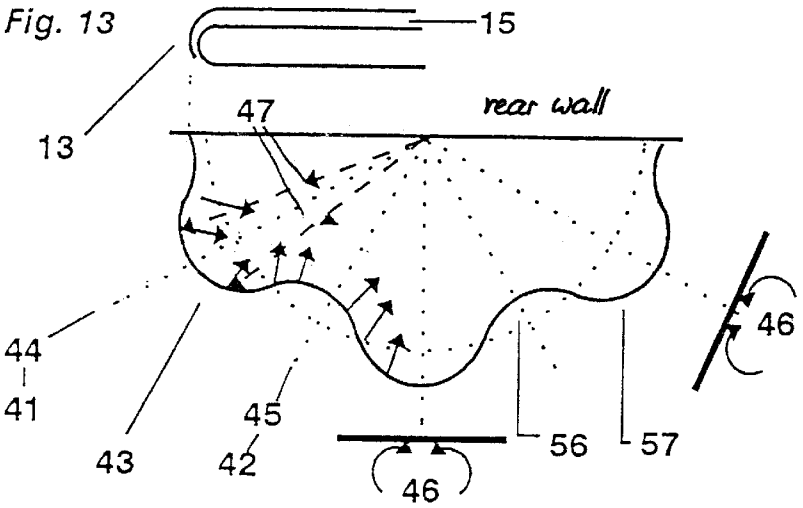
FIG. 13 is a representation of the front edge of the hood and the blow out slot with corrugations in lateral cross-section.

The flow path caused by the corrugations of a curved front side 13 of the hood is shown in FIGS. 13. The latter shows the underside of a hood, whereas FIG. 13 shows a vertical cross-section of the front side 13 of the hood and the blast channel 15. The blow out flow 47 flowing through the blast channel 15 is reflected by the deflection 43 of the wave crest 57 of the front side of the hood 13. It is directed towards the center line 44 of the wave troughs so that along this line a convergence 41 exists below the hood. Within the center lines 45 of the wave trough 46 a divergence 42 is generated. The generated helical longitudinal vortexes 46 below the hood are schematically shown on the extension of the center lines of the wave crests.

Figure 15:
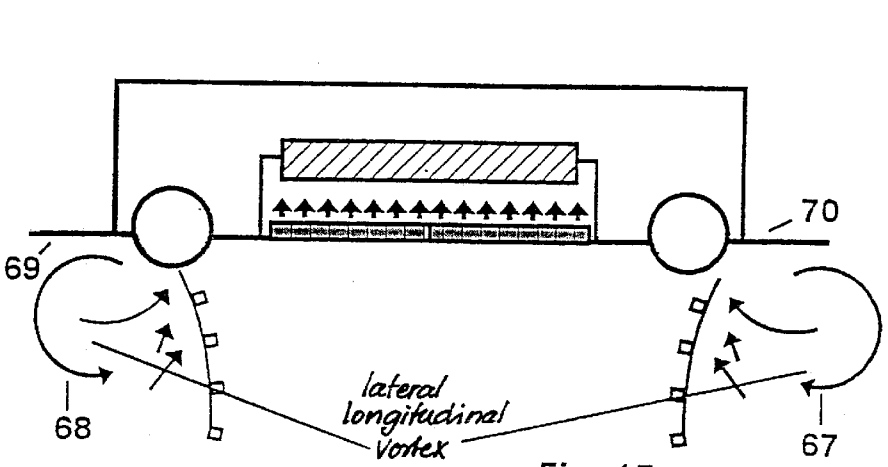
FIG. 15 is an exhaust hood with Coanda-effect in a frontal cross-section.
Figure 14:
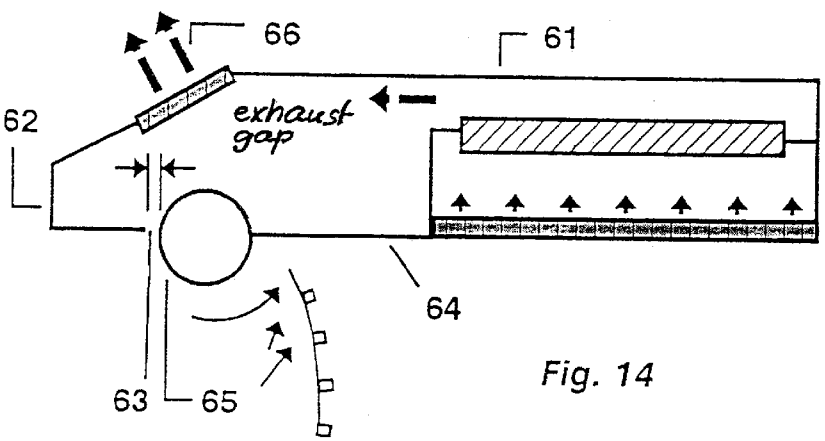
FIG. 14 is a schematic representation of an exhaust hood with Coanda-effect in lateral cross-section.

The embodiment according to FIGS. 14 and 15 refers to an exhaust hood with the Coanda effect. The hood has a rectangular cross-section and, according to FIG. 14, operates as a circulation hood. The hood 61 adjacent to the front side 62 is provided with an outlet opening for the blast air at the bottom 64 of the hood distant from the front edge or, alternatively, is offset rearwardly at a distance of approximately 50 mm. The blow out gap 63 has a width of about 4–5 mm and is restricted towards the rear side by a tube 65 circulated by air, which according to a special embodiment, has a diameter of 38 mm. The blow out speed of the blast air for this embodiment is about 2–3 m/sec. Shifting the blow out gap 63 further away from the front edge of the hood restricts the suction effect of the jet underneath the projection to half the space, and thereby amplifies the suction effect of the jet compared with the blow out aperture at the front edge of the hood. The exit of the circulated air is shown as 66 in FIG. 14. Longitudinal vortexes 67, 68 are generated at the lateral restrictions of the tube 65. These vortexes suppress a deflection of the vapor at the lateral edges of the hood. For a proper design of the longitudinal vortexes, it is important the they are arranged below a shield 69, 70. The end of the blow out slots 63, and therefore the tube 65, is to be located distant from the lateral edges, as shown in FIG. 15.

Figure 16:
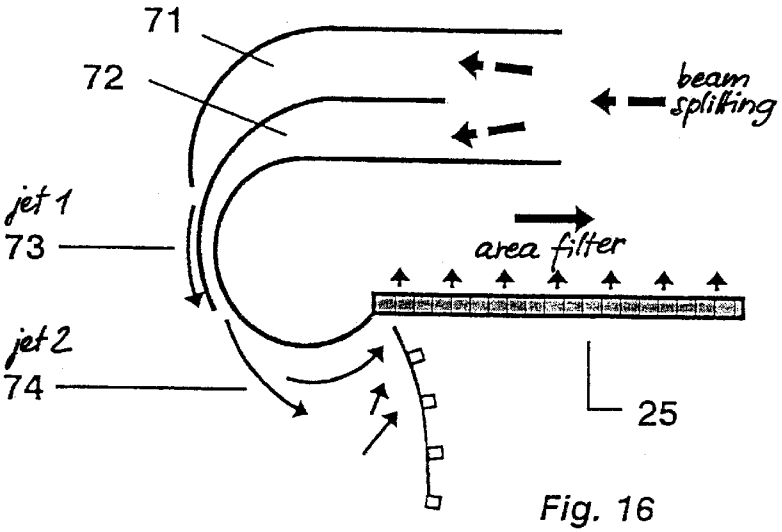
FIG. 16 is a schematic representation of the front edge of the hood with twin blast jet in lateral cross-section.

The twin jet exhaust hood shown in FIG. 16 has two blow out channels 71, 72, which are separate from each other. They pass the blast jets 73, 74 downwardly and inwardly, and generate a curved shearing or vortex flow. The two exit locations of the blow out channels are distant from each other or are staggered in height.

Figure 17:
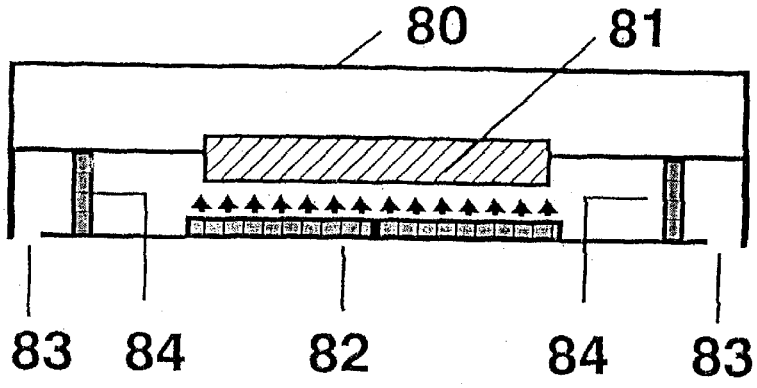
FIG. 17 is a revised embodiment of a hood according to FIGS. 14 and 15, FIGS. 18*a*–18*c* are further embodiments of hoods with edge suctioning.

FIG. 17 shows a revised embodiment of an exhaust hood with a Coanda effect according to FIGS. 14 and 15. The blast edge is at the front side of the lateral edges without an exhaust aperture. The hood 80 of FIG. 17 shows a fan 81, a surface filter 82 in the center area, edge filters 83, as well as an edge suction effect with suction slots 84. The filter elements 82, 83 are provided on an extension of the blow out channel behind the edge suction slots.

Figure 18A:
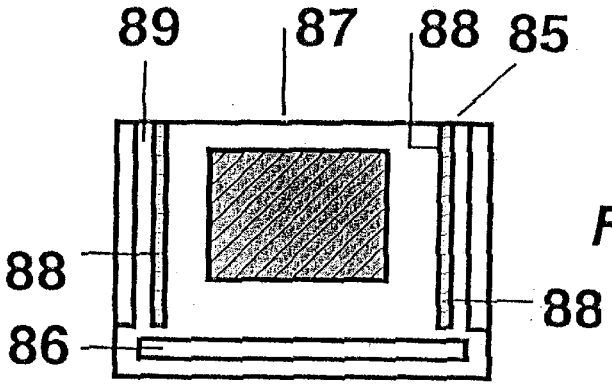
Figure 18B:
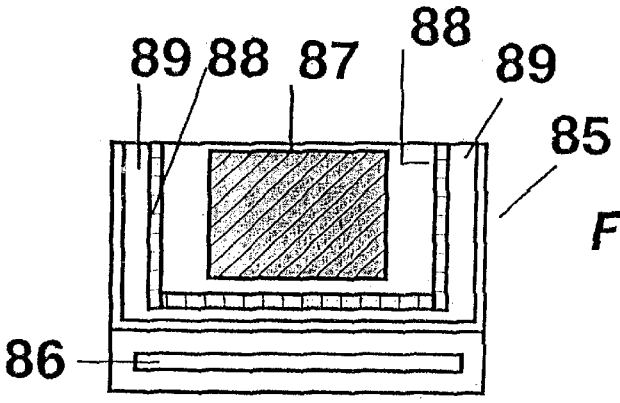
Figure 18C:
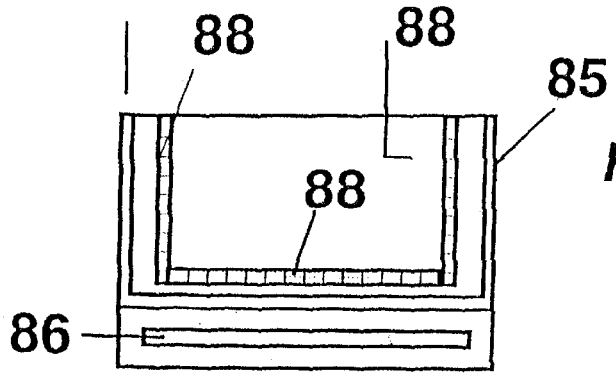

FIGS. 18*a*, 18*b* and 18*c* show different embodiments of Coanda vortex hoods with boundary suctioning effect in plan view, namely FIG. 18*a* with lateral edge suctioning, FIG. 18*b* with U-shaped edge suctioning and FIG. 18*c* without central suctioning. The hood 85 is provided with a front vortex generator 86, a center surface filter 87, edge filter 88 and suction slots 89.

Figure 19A:
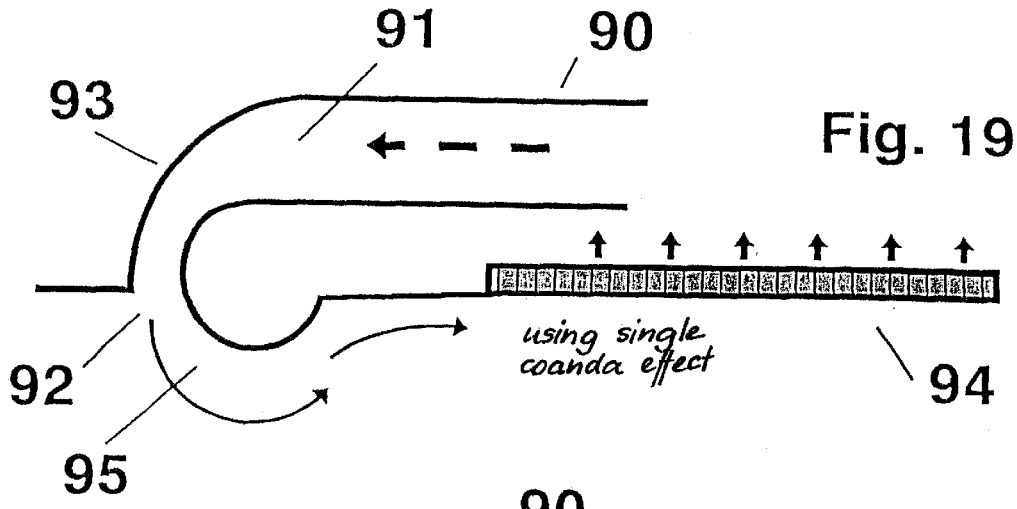
FIGS. 19*a*–19*c* are representations of exhaust hoods of different design with curved shearing flows for generating a front.
Figure 19B:
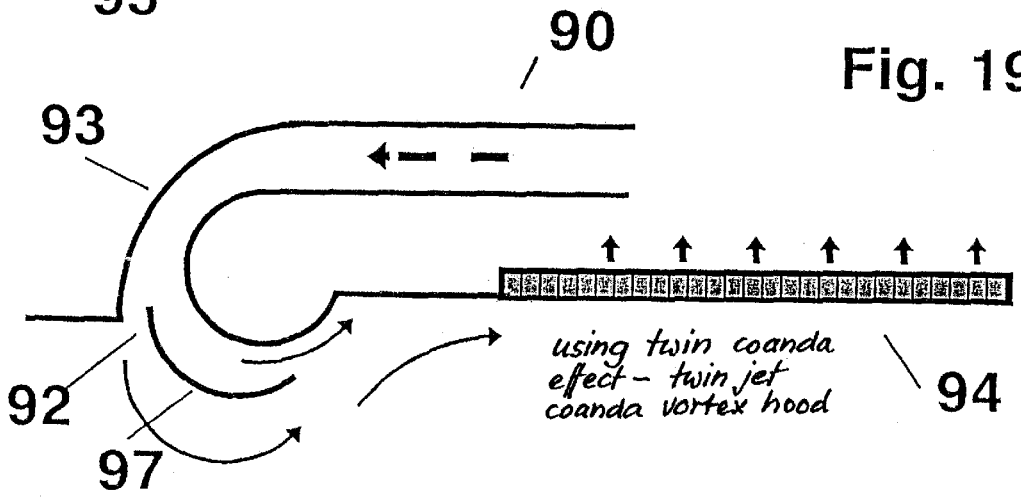
Figure 19C:
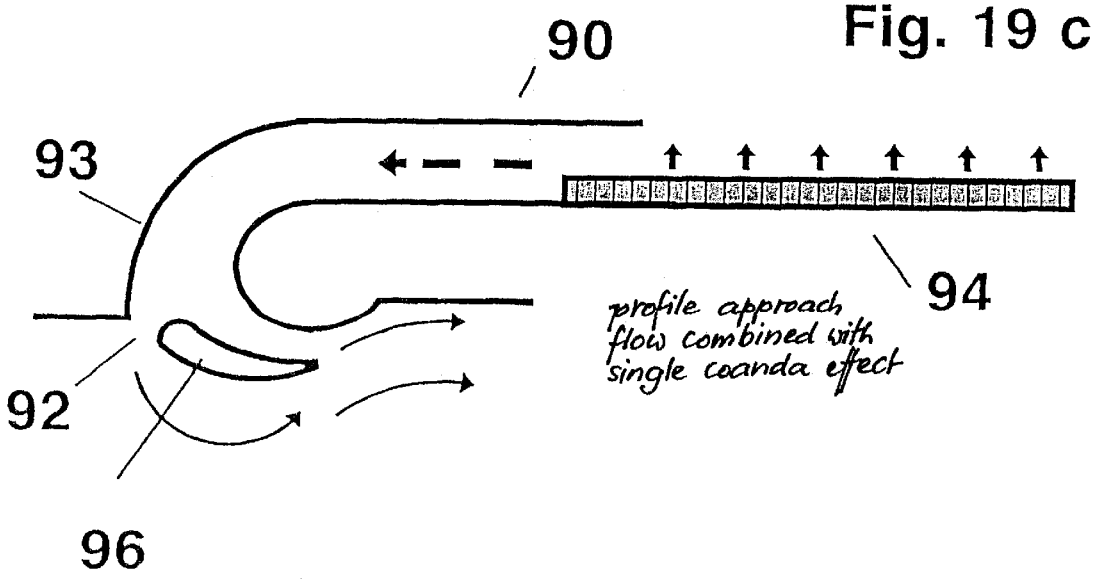

FIGS. 19*a*–19*c* schematically show a series of developments of exhaust hoods according to the invention using curved shearing flows for generating a front. FIG. 19*a* shows the basic use of the Coanda effect. FIG. 19*c* shows a twin-jet version using the Coanda-effect. The embodiment of FIG. 19*b* shows a two-jet version using the Coanda-effect. Transforming the semi-circular element of FIG. 18*b in*to a profile results in a combination of a profile body circulated by air (according FIG.) 9 with a Coanda-effect according to FIG. 19*c*. A second jet can either be provided along the entire exhaust length or at predetermined locations, at which the flow is to be in close contact. A combination with a profile according to FIG. 19*c*, against which the air is blast, is called a free jet, which after a short distance of flow becomes a wall jet, when air flows around the profile. The common characteristic of the front jet generators of FIG. 19 is that the flow is diverted by the "wall effect". Using a second wall jet according to FIG. 19*b* stabilizes the jet diversion so that the adherence of the jet at the bottom side of the hood is improved (see FIG. 21). The hood 90 is shown with a blow out channel 21, suction slots 92, curved blast jet guide 93, surface filter 94, Coanda-profile body 95, wing profile body 96 and twin blast channel 97.

Figure 20:
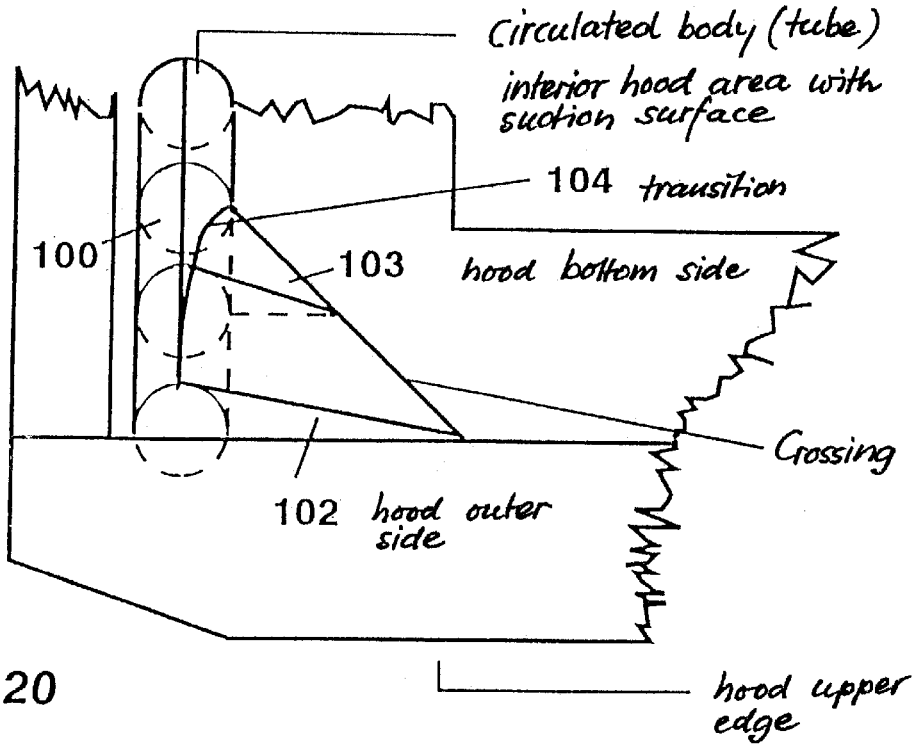
FIG. 20 is a basic diagram of an embodiment of a profile body formed as a tube, circulated by air.

The embodiment according to FIG. 20 shows a tube circulated by air, which hits a surface. This tube is the flow-around body of a frontal vortex hood. The surface is the underside of an exhaust hood. The tube is profiled towards the edge. The profile decreases outwardly, and is profiled increasingly steeper until, in the interior, the tube becomes the body circulated by air. The profile is provided at the outer side as a straight extension 101 of a tangent 102 to the curvature of the tube. The extension 101 is increasingly shortened towards the interior of the blow out device. The transient area 104 is the area in which the straight profile joins the curvature of the tube; the surfaces 101, 102, 103 restrict the body. The surface 103 is the extension of the bottom side of the hood.

Figure 21:
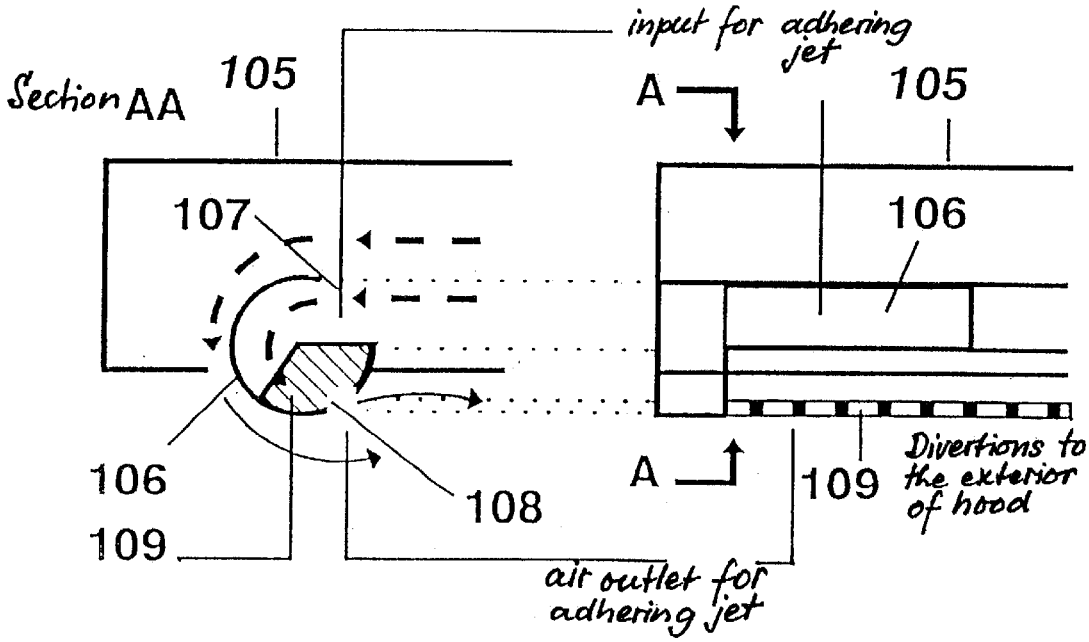
FIG. 21 is a further embodiment of a tube with a second wall jet.

According to the embodiment of FIG. 21, a second wall jet is blown out at the hood 105, acting as an adhering jet. This corresponds with the twin jet principle according to FIG. 16 and FIG. 19. A tube 106 within the lateral sides of the interior of the hood is provided with an inlet 107 for the air of the adhering jet. Below the hood 105, a slot 108 is provided as the exit for the adhering jet. By positioning the inlet and outlet openings 107, 108, as well as by positioning diversion means 109, such as air baffles in front of the exit, the adhering jet can be directed inwardly. However, an extension of the frontal vortex or the curved shearing flow also can be provided by means of an additionally generated longitudinal vortex at the ends of the blow out means. Stabilizing the blast flow by offsetting, boundary layer suctioning near the suction surface or by an adherence jet also can be arranged at other critical locations of the blow out means.

Figure 22:
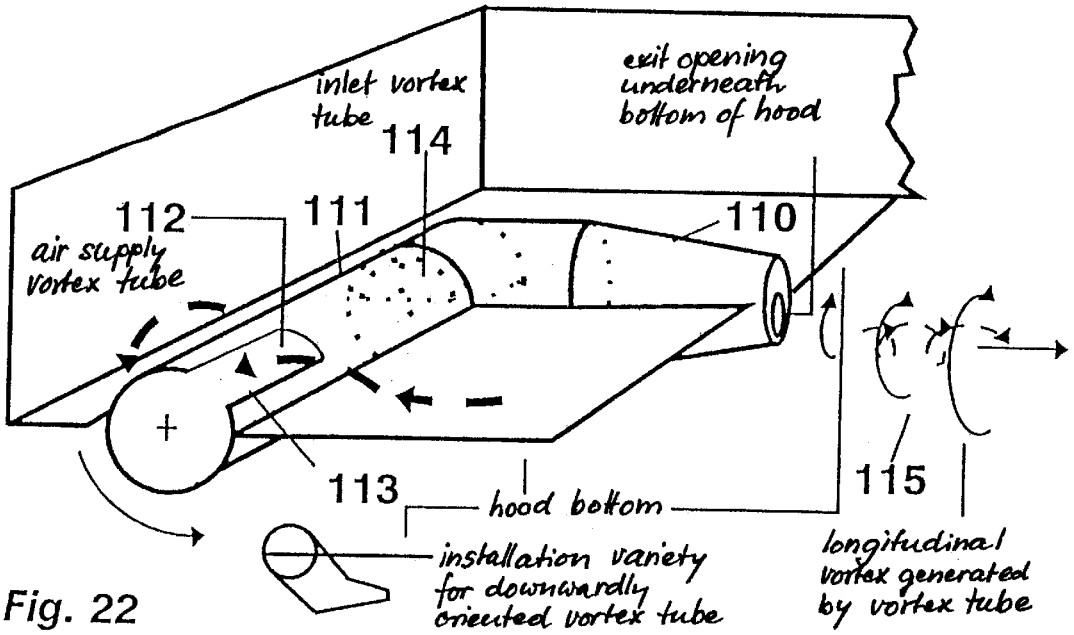
FIG. 22 is a different embodiment of a tube with a vortex tube.

FIGS. 22 shows a vortex tube 101 with a radial and an axial flow continuously combined, whereby this flow is changed into a rotating jet at the exit. This flow can be used as an extension of a blow out flow. Accordingly, a tube 110 is provided at the outer side of which a vortex tube 110 joins. Tube 110, circulated by air, operates as the air supply for the vortex tube 110. The air for the vortex tube originates from the blast space 112 (which is the space above the bottom of the hood) and passes through the aperture 113 within tube 111 and through the inlet 114 into the vortex tube 110. Jet 115 leaving the exit aperture, and forming the jet with a longitudinal vortex generated by the vortex tube, preferably is directed towards the interior of the hood and towards the suction surface.

Figure 23:
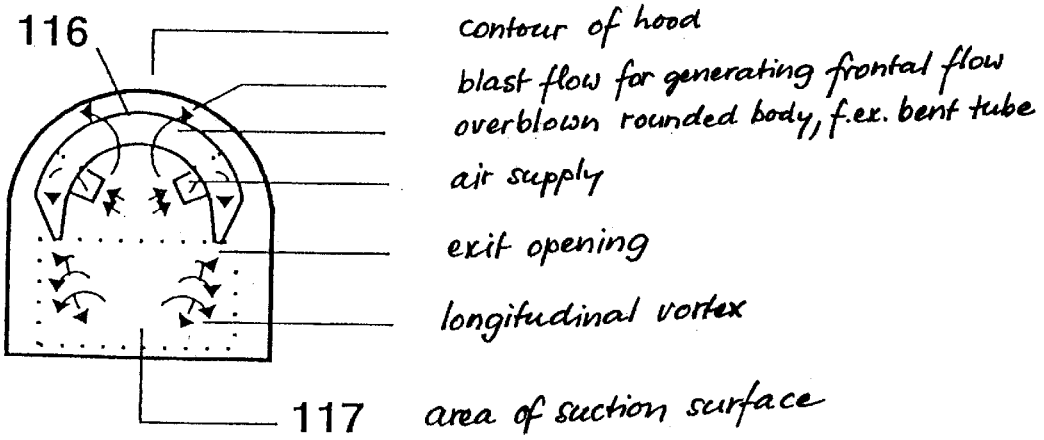
FIG. 23 is a basic representation of a vortex tube for a semi-circular hood.

In FIG. 22, the exit stream from the vortex tube 110 passes non-concentrically into the frustum so that it leaves the hood below the bottom of the hood. The vortex tube also can be oriented downwardly in an inclined manner into the space below the bottom of the hood, and the frustum which is used for converting the flow, can point in the required direction. The rotation al direction of the frontal vortex and the longitudinal vortex is chosen so that the longitudinal vortex at the corners forms an extension of the frontal vortex or the curved shearing flow generating the front. The vortex tube 110 is especially suitable for extending the frontal flow structure at the lateral sides in case of cornered hoods. The vortex tube also can be used with semi-ring shaped hoods, whereby the hollow body circulated by air, in general a tube, changes into a vortex tube. This is schematically shown in FIG. 23. The curved element 116 is the plan view on a curved tube circulated by air, which tube is a rounded body. Joining the ends of this rounded tube are vortex tubes. FIG. 23 is a view from the top onto the open hood. The longitudinal vortexes starting from the exit apertures of the vortex tubes are visible through the suction aperture 117.

What is claimed is:

1. A process for confining, retaining and sucking off vapors or dust by a hood according to which the vapor or dust having a vapor flow is sucked off from a vapor area by a suction fan creating a suction flow with filtering via air channels, a suction surface being formed on the bottom surface of the hood, and within a lower front area of the hood a blow out flow is generated from a blast channel counteracting the vapor flow, said process including the following steps:

a. diverting the blow-out flow into a vortex flow adjacent a front side of an exhaust hood, b. forming the blow-out flow by an interaction with a front flow ahead of the suction surface, c. an effective suction surface extending downwardly along part of the distance from a working table, and d. a blow-out jet generating a frontal flow shielding the vapor by interacting with the bottom edge of the hood and the vortex flow transporting the vapor to the suction surface.

2. The process according to claim 1, wherein fan air is blown into the vapor space via a profiled area in an inclined direction so that below the bottom of the hood a deflected shearing flow and a vapor confining front as well the vortex flow transporting the vapor to the suck off areas is generated.

3. The process according to claim 1, wherein a free jet from the hood is blown against a profile surface and is deflected to generate a front confining the vapor below the hood and the vortex flow retaining the vapor and passing it to the suction surfaces is generated.

4. The process according to claim 1, wherein the vortex flow is combined with an edge suctioning effect.

5. The process according to claim 1, where the blow out flow discharged from the hood is passed between a vertical free jet exiting the front of the hood.

6. The process according to claim 1, wherein a boundary suctioning effect is provided at the edges of the hood which is formed as a slot suction, whereby a filter is arranged in a widening area of the air channel.

7. An exhaust hood for carrying through the process according to claim 6, wherein distant from the blow out flow exit, a suction slot is provided within the bottom of the hood, and the suction flow is directed so that it passes the front towards the vapor flow.

8. The exhaust hood according to claim 7, wherein a suction trough is provided at the bottom of the hood joining the suction slot which is curved inwardly and upwardly, and forms a restriction of the air channel near the filter.

9. The exhaust hood according to claim 7, wherein an edge filter is associated with the suction slot within the air channel.

10. The process according to claim 1, wherein the blow out flow is crossed in order to obtain a more stable and close flow of the stream at the corners.

11. An exhaust hood for carrying through the process according to claim 10, wherein at the blow out flow exit a profile is provided within the path of flow of an exiting free jet, said profile is approached so that the vortex flow and a front is generated.

12. An exhaust hood for carrying through the process according to claim 10, wherein flow restrictions are arranged within the blast channel flow for adjusting the volume flow, and within the air channel passing the suction flow.

13. The exhaust hood for carrying through the process according to claim 10, wherein the front side of the hood is provided as a curved blast channel, which narrows at its exit and having an inner restriction wall which is of part-circular cross-section, the blow out flow forms the vortex flow flowing along the outer side of the inner restriction wall and also forms the front, and the inner restriction wall joins a surface filter.

14. The exhaust hood according to claim 13, wherein a part-circular confining wall is provided with openings for boundary layer suction.

15. An exhaust hood for carrying through the process according to claim 10, wherein the front side of the hood is formed as a curved blast channel, which narrows at the exit and an inner restriction wall of which is a downwardly and inwardly inclined extending plane plate with a breaking edge joined by an inwardly curved surface, which joins the surface filter so that below the plate a curved shearing flow and at the curved surface a detach vortex is generated.

16. An exhaust hood for carrying through the process according to claim 10, wherein the suction fan and a blast air fan are connected by a common suction space behind the filter surfaces.

17. An exhaust hood for carrying through the process according to claim 10, wherein the suction fan and a blast air fan are connected with separate suction spaces.

18. The process according to claim 1, wherein the blow out flow at the corners is effected by boundary layer suctioning so that a more stable and closer adherence of the flow of obtained.

19. The process according to claim 1, wherein adjacent the corners of the blow out flow, a suction off surface is positioned, which results in a more stable and closer adhering blow off flow.

20. The process according to claim 1, wherein adjacent the corners of the blow out flow, a second jet is blown off, to obtain a better adherence of the flow.

21. The process according to claim 1, wherein vortex tubes are arranged at the corners of the blow out flow so that a longitudinal vortex generated by the vortex tubes provides the passing-on of the blow out flow and generates a vortex flow directed towards the suction surface in order to stabilize the stream.

22. The process according to claim 1, wherein the thickness of a blow off slot is reduced outwardly for obtaining a more stabilized and closer contact of the stream at the lateral sides of an exhaust hood.

23. An exhaust hood for carrying through the process according to claim 1, characterized in that at the front end of the hood means are provided for deflecting the blow out flow exiting from the hood, said means generate a flow, that the flow is deflected so that a vortex flow moves the vapor to the suction surface, and that by deflecting the flow a front is generated, which shields the vapor area by cooperating with the bottom of the hood.

24. The exhaust hood according to claim 23, wherein a surface is provided which transforms the downwardly directed blow out flow into the vortex flow below the bottom of the hood for obtaining a front at the exit of the blow out flow on the side of the hood associated to the vapor area.

25. The exhaust hood according to claim 24, wherein the surface is of circular segment form.

26. The exhaust hood according to claim 24, wherein the surface is a curved, profiled surface.

27. The exhaust hood according to claim 24, wherein the surface is an inclined, planar plate.

28. The exhaust hood according to claim 24, wherein the surface is a combination of a straight plate and a inclined surface.

29. The exhaust hood according to claim 28, wherein the inner side of the blast channel is curved and joined by a substantially vertical plane surface for forming a wall jet, the plane surface joining a curved surface.

30. The exhaust hood according to claim 24, wherein the blast channel is curved, and decreases in diameter downwardly, and the air channel is formed as a partial ring and receives an edge filter.

* * * * *